United States Patent [19]

Saffrhan

[11] Patent Number: 4,776,727

[45] Date of Patent: Oct. 11, 1988

[54] QUICK RELEASE PLATFORM GROUTING VALVE SYSTEM

[75] Inventor: Ray W. Saffrhan, Gretna, La.

[73] Assignee: Shell Offshore Inc., Houston, Tex.

[21] Appl. No.: 58,970

[22] Filed: Jun. 8, 1987

[51] Int. Cl.[4] ..... E02B 17/02

[52] U.S. Cl. ..... 405/225; 405/191

[58] Field of Search ..... 405/169, 185, 190, 191, 405/195, 224, 225, 227

[56] References Cited

U.S. PATENT DOCUMENTS

| | | | |
|---|---|---|---|
| 4,030,434 | 6/1977 | Miller et al. | 405/191 |
| 4,214,843 | 7/1980 | Rodhe | 405/225 |
| 4,618,285 | 10/1986 | Ahlstone | 405/191 |
| 4,682,913 | 7/1987 | Shatto | 405/191 |

*Primary Examiner*—David H. Corbin

*Attorney, Agent, or Firm*—Mark A. Smith

[57] ABSTRACT

A quick release grouting valve system is disclosed in which the valve system is provided in a first portion and a second portion which are joined together by a locking mechanism which is releasable by ROV manipulation of a protruding release handle relative to and adjacent protruding stationary handle.

12 Claims, 4 Drawing Sheets

QUICK RELEASE PLATFORM GROUTING VALVE SYSTEM

BACKGROUND OF THE INVENTION

This invention relates to a quick release grouting valve system for injecting grout into an inlet port for grouting skirt piles within skirt sleeves at the bottom of a platform so as to anchor the platform to the ocean floor at a deepwater location.

Offshore structures in the form of large offshore platforms are erected on the ocean floor for the purpose of drilling a large number of wells into the ocean floor in order to develop oil and/or gas fields. Typically, a platform takes the form of a rectangular structure with a plurality of legs upwardly extending from the ocean floor to a point above the surface of the water where a platform deck is supported by the legs. In order to anchor the structure to the ocean floor and prevent its overturning, the structure is usually provided with a plurality of short skirt sleeves in the form of elongated cylindrical elements welded to the lower end of the platform and extending substantially parallel to the legs thereof. A smaller diameter tubular pile is driven through the skirt sleeves to a secure reception in the ocean floor, the top of the pile is cut off, and the pile and skirt sleeve are then cemented together.

A common method of cementing piles within skirt sleeves in accordance with prior art uses a cementing pipe welded to each of the legs of the platform. Each cementing pipe extends from the top to the lower end of the platform where a lateral pipe runs to one or more skirt sleeves which are outboard of the legs of the platform. After a pile has been driven and cut off to desired length, grout is pumped down the cement or grout line outside of the leg, and through the crossover lateral pipe which is in communication of the interior of the skirt sleeve, and fills an annular space between the pile and the skirt sleeve.

The Applicant has improved the grouting system described above and is proposing the use of a system using a flexible grouting hose deployed from a service barge. This improved system is the subject of a co-pending application filed by the present Applicant for a platform grouting valve system and method. In the improved method a supply of grout, a grout pump, and one or more underwater remotely operated vehicles (ROVs), together with lowering winches and control stations for the ROV are provided by the service barge. Further, each of the skirt sleeves is provided with one or more valved grout inlet ports. A connection is established in the lower end of the grouting hose and the grout inlet ports of the skirt sleeves and a slurry of grout is pumped down through the grouting hose and into the annular space formed between the pile and the surrounding skirt sleeve.

The ROV then disconnects the grouting hose from the grout inlet port and flies through the water towing the flexible grouting hose behind it so as to stab the next grout inlet port and so on through successive grout inlet ports and pile sleeves of the structure. If desired, a series of grout inlet ports may be arranged vertically at spaced apart intervals along the pile sleeve which may be several hundred feet or more in height so that individual sections of the annular space may be separately grouted. Preferably, the grouting hoses are connected first to the lowermost inlet port on the sleeve so that the grout flows upwardly to the annular space within the sleeve and out the top thereof.

Thus, it can be seen that the practice of such a grouting system requires a large number of connections to be established, moved and reestablished between grout inlet ports and the lower end of the grouting hose. However, connections such as between the grouting hose and the grout inlet ports are difficult to establish in deep water applications. This is particularly true at depths for which the use of divers is generally not feasible and ROV operations must be relied upon. Therefore, there is a need for a platform grouting valve system which is particularly adapted for ROV operation. Further, a platform grouting valve system suitable for such connections must also provide for efficient disconnection to facilitate repeated placement, connection, grouting operations, and redeployment as each of the piles are grouted about the base of the platform.

SUMMARY OF THE INVENTION

Therefore, it is an object of the present invention to provide a quick release platform grouting valve system capable of secure deployment and rapid disconnection for redeployment.

It is a further object of the present invention to provide the platform grouting valve system with a rapid disconnect mechanism that is well suited to ROV operation.

Toward these and other objects, the platform grouting valve of the present invention provides a first valve portion and a second valve portion in which the first valve portion is connected to a first end of a grout flowing conduit and has a housing, a locking means within the housing, a release handle operably connected to the locking means and a stationary handle adjacent and parallel to the release handle. The second valve portion is connected to the second end of the grout flowing conduit and cooperates with the locking means to secure the first end and the second end of the grout flowing conduit together. The release handle and the stationary handle provide an ROV adapted quick release which facilitates the repetitive grouting operations necessary to secure a platform foundation.

BRIEF DESCRIPTION OF THE DRAWINGS

The above brief description as well as further objects, features and advantages of the present invention will be more fully appreciated by reference to the following detailed description of the presently preferred emodiment of the present invention with reference to the accompanying drawings in which.

DETAILED DESCRIPTION OF THE PREFERRED EMBODIMENT

Figure 1:
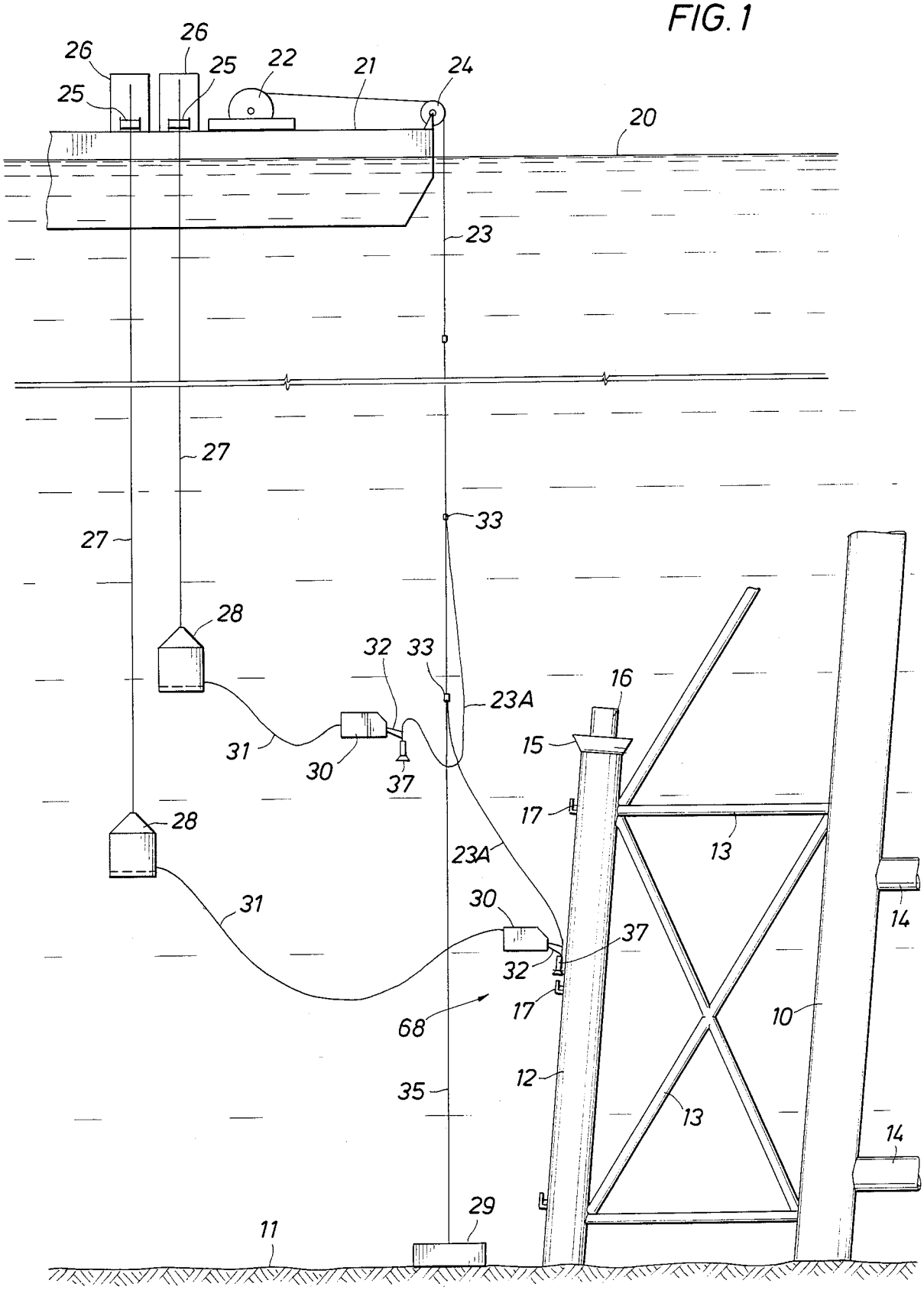
FIG. 1 is a side elevational view of a grouting operation in which a quick release platform grouting valve system according to the present invention is deployed.

In FIG. 1 of the drawings, one leg 10 of an offshore platform is illustrated as being seated on an ocean floor 11. Outboard of let 10 is a skirt sleeve or pile sleeve 12 which is rigidly secured to let 10 and other members of the platform by cross-bracing members 13. Cross braces 14 are merely illustrative of cross braces which connect the adjacent legs together. Providing skirt sleeve 12 with a flared top 15 aids in inserting pile 16 into the skirt sleeve. Arranged at spaced intervals along skirt sleeve 12 are a series of grout inlet ports which provide a fixed portion 17 of a quick release platform valve grouting system, valve system 68.

A cementing barge 21 is positioned nearby the platform site on the surface of the water 20 and provides a grout or cement slurry for use in cementing the pile within the skirt sleeve 12.

Barge 21 is provided with a single drum hydraulic winch 22 for handling grouting hose 23 having a lower flexible end 23A. A hose sheave 24 is provided at the edge of barge 21 to facilitate lowering the grouting hose through the water. Further, the grouting hose should be capable of supporting its own weight when deployed in the water from an anchored position on surface barge 21. The barge is also equipped with one or more cable winches 25 for use in lowering one or more ROV cages 28 down through the water to the approximate depth at which ROVs 30 are to operate. ROVs 30 are connected to their respective cages 28 through tethers 31 which are adapted to transmit power through cables 27 to ROV's 30 while returning signals back to control stations 26 on barge 21. Underwater vehicles of this type together with their cages and control stations are well-known to those skilled in the art and are merely used for carrying out certain portions of the grouting method facilitated by the present invention. Each ROV is equipped with one or more manipulator or operator arms 32 for carrying out operations underwater together with TV cameras and lights for observing the operations.

In order to reduce the lateral movement of grouting hose 23 within the water due to currents, it is preferred that the grouting hose be equipped with a hose clamp 33 which is clamped on the grouting hose at a suitable operating distance above the ocean floor and is provided with a shackle mount from which a wire line 35 extends downwardly to a clump weight 29 of suitable size for the operating conditions on ocean floor 11.

The lower end of flexible section 23A of the grouting hose is provided with a movable portion 37 of the quick release platform grouting valve system of the present invention which is adapted to mate with the cooperating fixed portions 17 of the valve system which are rigidly attached to the outside of the skirt sleeve 12. Thus, ROV 30 is flown downwardly and aligns the movable portion 37 of the valve system with fixed portion 17.

Figure 2:
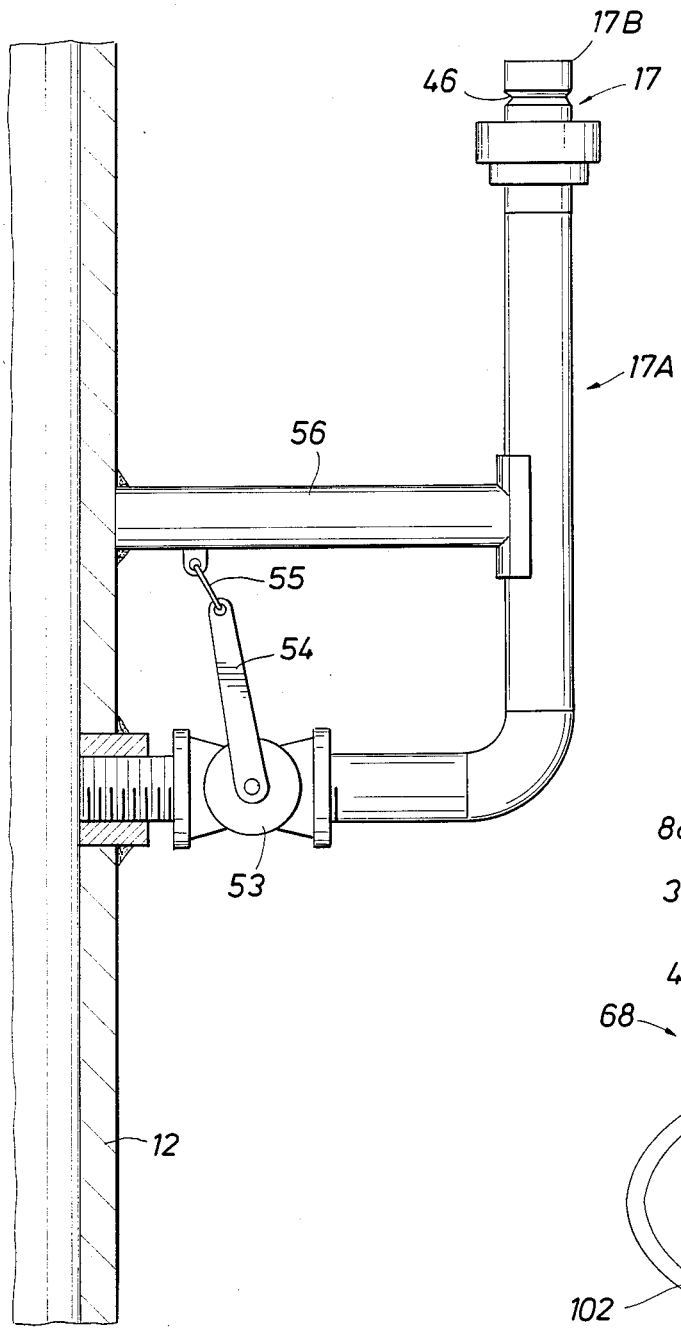
FIG. 2 is a side elevational view of a grout inlet port presenting a fixed portion of a quick release platform grouting valve system in accordance with the present invention.
Figure 3:
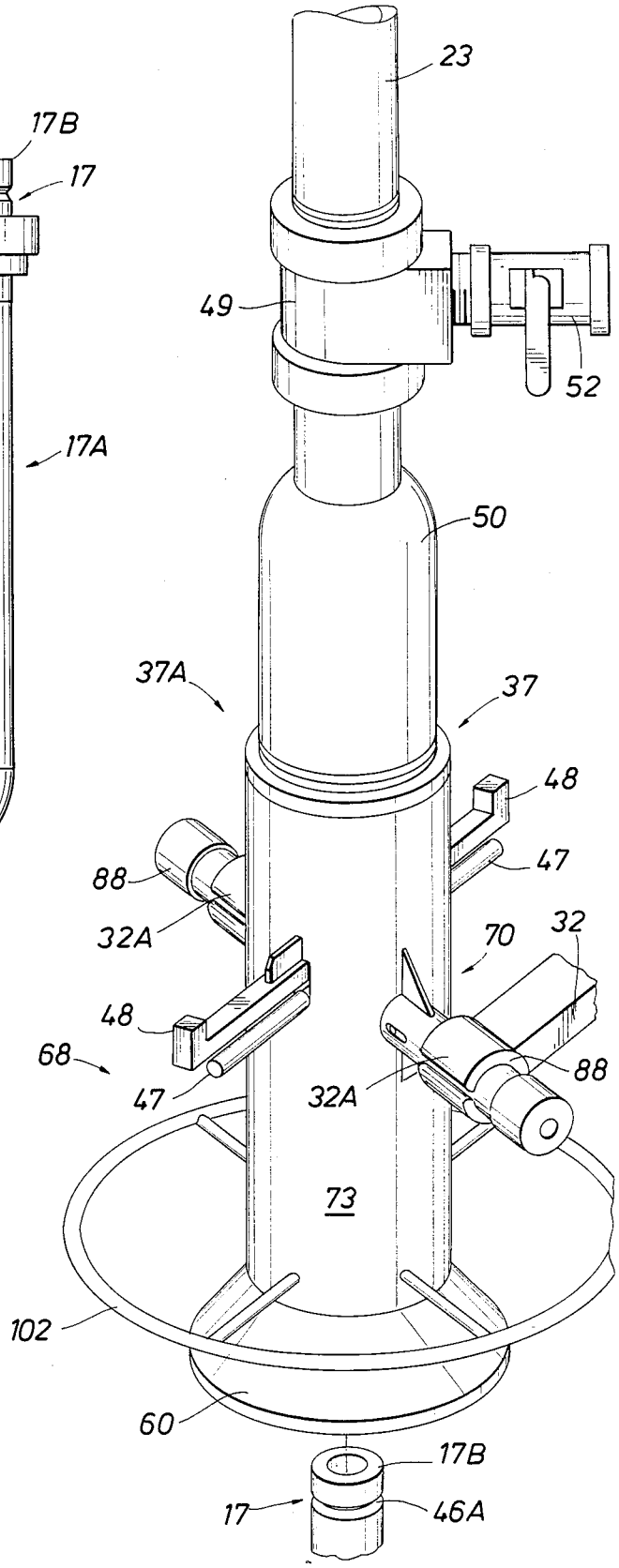
FIG. 3 is a prespective view of a movable portion of a quick release platform grouting valve system in accordance with the present invention.
Figure 5:
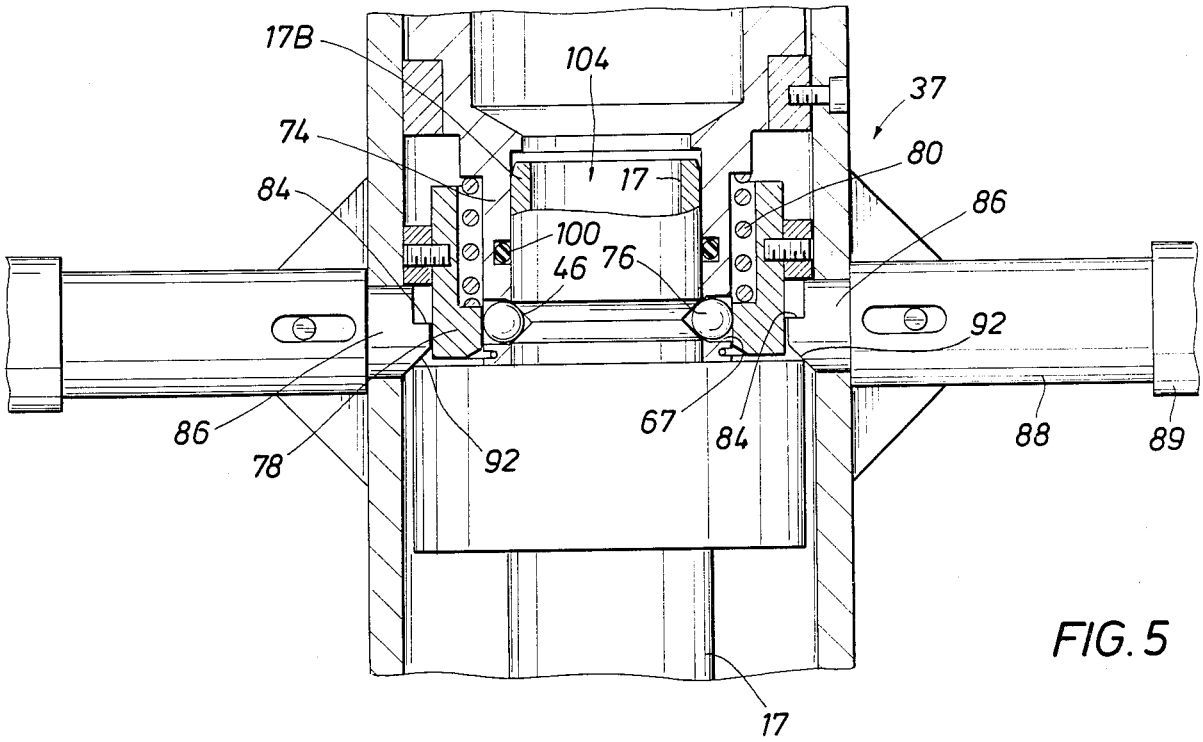
FIG. 5 is a partially cross-sectioned side view of a quick release platform grouting valve system constructed in accordance with the present invention in which the movable portion is secured to the fixed portion.
Figure 6:
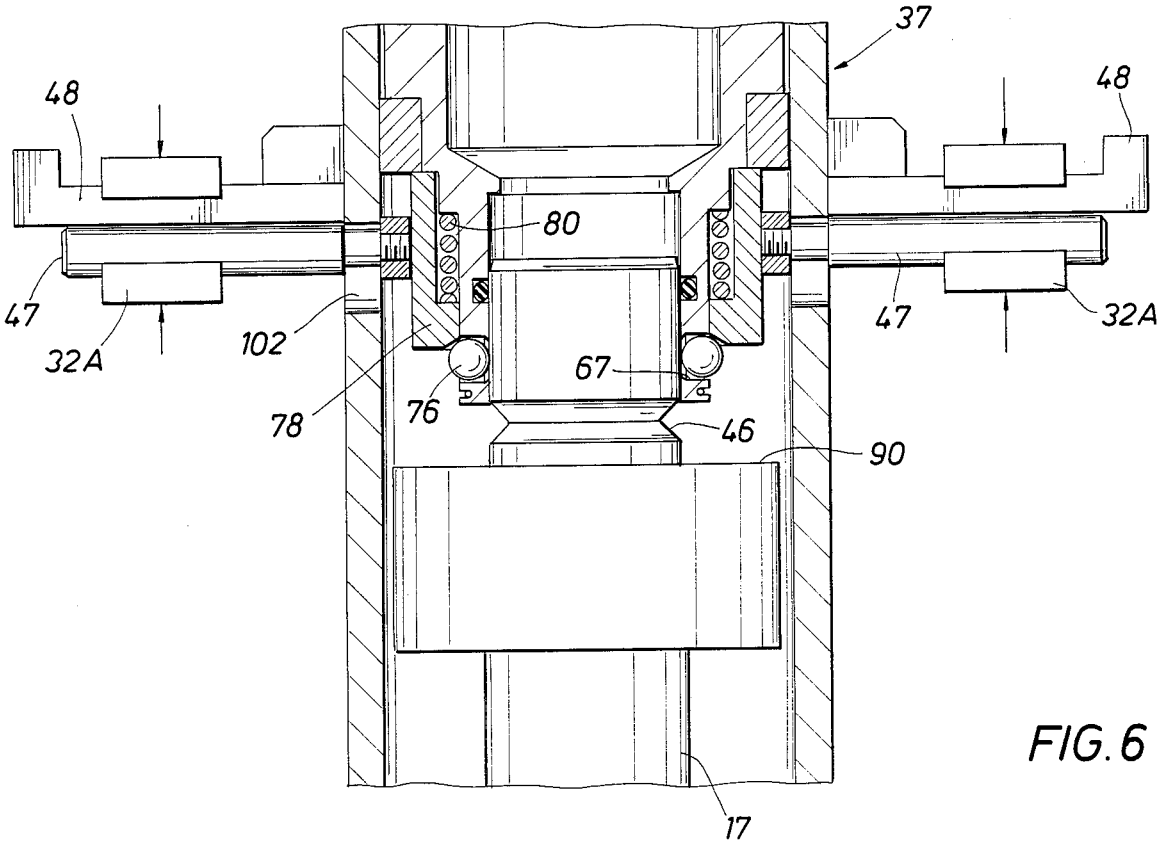
FIG. 6 is a partially cross-sectioned side view of a quick release platform grouting valve system in accordance with present invention immediately after release for disconnection.

FIGS. 2 and 3 illustrate the quick release platform grouting valve system of the present invention having a first valve portion 37A and a second valve portion 17A in which one of the valve portions is movable and one is fixed to the skirt sleeve and in which the valve portions are connectable to form a grout flowing conduit 104. See the engagement position of the valve system in FIG. 5. The first valve portion is provided with a locking means 70 and a release handle 47 operably connected to the locking means adjacent a stationary handle 48 which is affixed to a housing 71 of the first valve portion to provide an ROV engagable means for releasing the connection which establishes the grout flowing conduit.

In the preferred embodiment, the second valve portion is provided in the form of a fixed portion 17 at skirt sleeve 12 and presents a male coupling member 17B having receiving means 46A for cooperative engagement with the locking means of first valve portion 37A. Further in the preferred embodiment, the first valve portion is provided in the form of female movable portion 37 having a female coupling member provided in the form of an engaging sleeve 74. The male coupling member of fixed portion 17 is adapted to fit within the female coupling member of movable portion 37 when the latter is forced thereon by operating arm 32 of ROV 30. Valve system 68 is provided with the means 70 for locking the connection between the movable portion and the fixed portion of the valve system.

Since it is preferred to have the movable portion of valve system 68 vertically stab as a female member onto fixed portion 17, the male fixed portion of the valve system is illustrated mounted vertically to the skirt sleeves and the movable portion of the valve system is recited to be a female member carried on the lower end of the grouting hose. Further, it is most convenient that the locking means be provided in the female member to operate externally to the male coupling member. However, it is understood that the first and second valve portions as well as the male and female portions of the connector may be interchanged on the equipment illustrated.

The male fixed portion of valve system 68 of the preferred embodiment is provided with a locking groove 46 into which suitable latches, dogs, collet fingers or locking balls fit in the locked position. The female movable portion 37 of the valve system is equipped with a release handle 47 which is adapted to be engaged by claws 32A located on the end of manipulator arms 32 of ROV 30 and squeezed against a stationary handle 48 so as to raise upwardly a sliding lock sleeve within movable portion 37 of the valve system. The handles 47 and 48 also provide the ROV an opportunity to easily lift a movable portion 37 of the valve system off fixed portion 17.

The preferred embodiment illustrated in FIG. 3 disposes spring housings 88 at 90 degrees to stationary handles 48 and release handles 47 and provides a circular guard handle 102 at a radius projected about the female movable portion which will protect these members.

A reducer section of pipe 50 connects movable portion 37 of the valve system to grouting hose 23 through a tee 49 which has a dump valve 52 connected to the outlet of the tee for emptying grout from the grouting hose after the cementing operation has been completed. Dump valve 52 may be of any suitable type, but is preferably of the type of which the open and closed states are readily observable to an operator through an ROV mounted TV camera.

Male fixed portion 17 of the valve system is secured to skirt sleeve 12 with any suitable arrangement, preferably with a valve 53 inserted just outside the support in the wall of the skirt sleeve in a manner that can be selectively opened or closed. Any suitable type of valve may be employed, but preferably a plug valve is used as illustrated having a handle 54 which is secured by a wire 55 to a horizontal support member 56 to hold it closed and provide protection to the equipment during launching of the platform base.

The pre-installed fixed portion 17 of the valve system is placed on the outer surface of the skirt sleeves 12 at points selected to facilitate cementing operations and to provide a location and orientation for each of fixed portions 17 which minimized the chances of the tether 31 of ROV 30 (See FIG. 1) hanging up during the lateral movement of the ROVs while the female movable portion 37 is shifted between the fixed portions 17. Further, it should be noted that fixed portion 17 may be provided with an ROV removable protector or dust cap during installation of the platform to prevent collection of any debris during fabrication and installation which might block the grouting injection ports.

FIG. 3 illustrates female movable portion 37 of valve system 68 approaching to stab onto male fixed portion 17. Claws 32A on manipulator arms 32 of the ROV (not shown in this Figure) grasp the female movable portion and guides it into position for mating. An external housing 73 of the female movable portion is preferably provided with a downwardly-directed flared opening or stabbing cone 60 to facilitate aligning the female movable portion to the male fixed portion as illustrated in FIG. 4.

Female movable portion 37 may be conveniently grasped by the ROV adjacent dump valve 52 for seating the female movable portion onto the male fixed portion of the valve system as illustrated in FIG. 1. Alternatively, spring housings 88 offer a grasp position closer to the interface of the docking members. In the preferred embodiment, engagement of locking means 70 is self-engaging and does not require external manipulation of release handle 47. Once in general alignment, the buoyancy of the ROV is decreased and gravity may be employed to make the connection.

Figure 4:
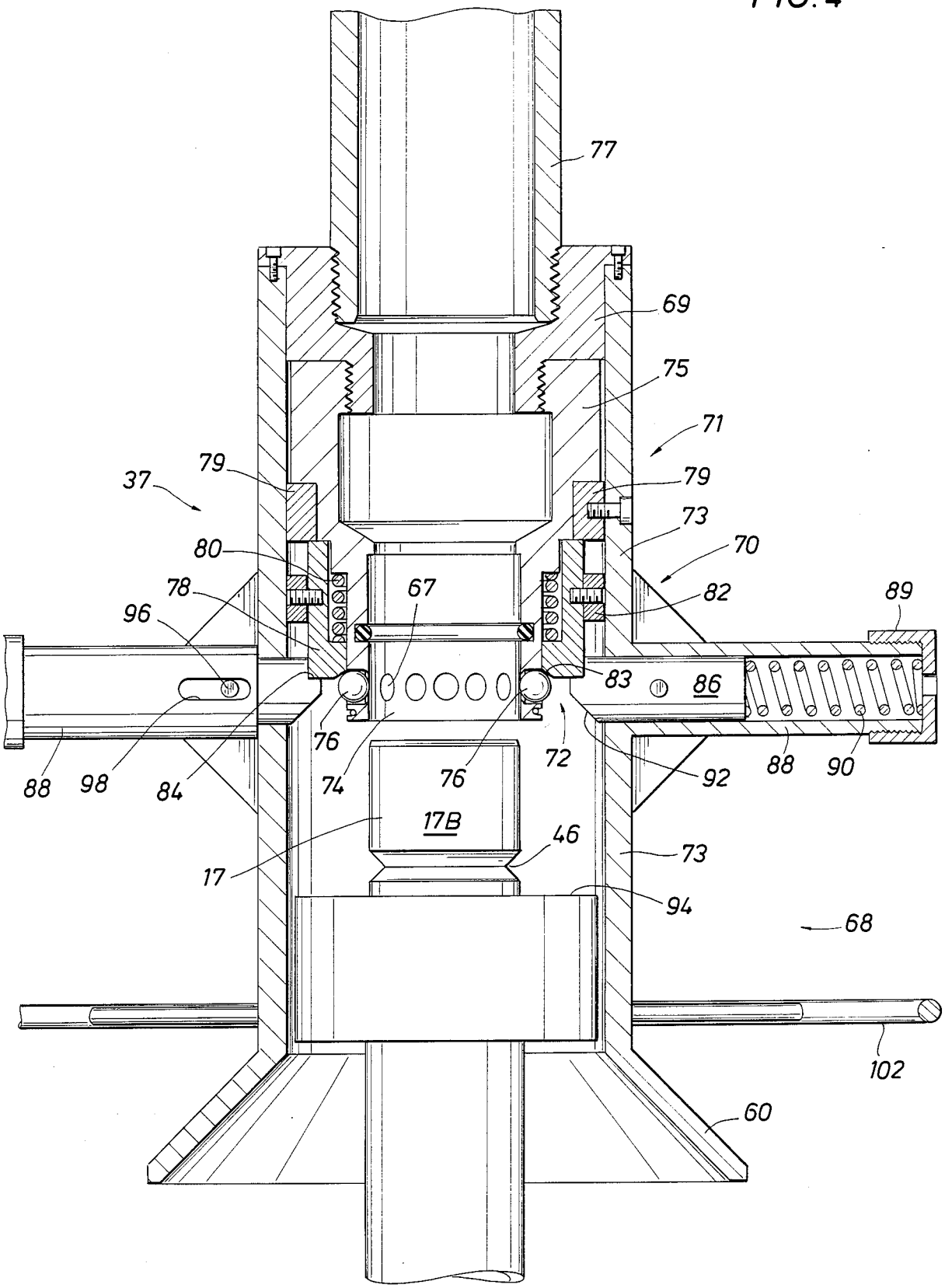
FIG. 4 is a partially cross-sectioned side view of a quick release platform grouting valve system in accordance with the present invention in which the movable portion is about to engage the fixed portion.

The cross section of the preferred embodiment in FIG. 4 illustrates the constituent members which make up housing 71 of female movable portion 37 of valve system 68, including external housing 73, internal housing 75, joint 69 and upper housing 77. A seal 79 seals the interior and exterior housings together.

The means 70 for locking movable portion 37 to male fixed portion 17 of valve system 30 interfaces with receiving means which are provided b y locking groove 46 on the male fixed portion and, in the preferred embodiment of FIG. 4, the locking means is provided by a locking ball assembly 72 carried within the external housing of the female movable portion.

Locking ball assembly 72 includes an engaging sleeve 74 within external housing 73. The engaging sleeve is formed from the lower end of internal housing member 75 and provides a plurality of locking ball apertures 67, of a diameter such that the locking balls 76 may protrude, but not pass through, into the inner diameter of the engaging sleeve. A sliding lock sleeve 78 is slidingly received between the external and internal housings and biased downwardly by a sleeve spring 80. The sliding lock sleeve is spaced from external housing 73 by friction-reducing ring 82.

FIG. 4 illustrates movable portion 37 of valve system 68 in a pre-engagement position in which a ball-camming beveled edge 83 carried on the inside, lower edge of sliding lock sleeve 78 secures locking balls 76 within locking ball apertures 67, but does not cause the locking balls to substantially protrude into the inside diameter of engaging sleeve 74. Sliding lock sleeve 78 is held in this position against the biasing of sleeve spring 80 by a retaining edge 84 of a cam latch 86. The base of the cam latch is slidingly received into a spring housing 88 along with a latch spring 90 which biases cam latch 86 toward the interior of external housing 73. The lower edge of cam latch 86 provides a camming surface 92 disposed to advance the cam latch into spring housing 88 upon engagement with engaging ring 94 of fixed portion 17 of valve system 68. Preferably, the end caps 89 are threadingly received on spring housing 88 and allow for adjustment of the compression in latch spring 90. Further, the sliding movement of cam latch 86 is limited by post 96 secured to the cam latch, which slides within a slot 98 of spring housing 88, so as to preserve the proper orientation of retaining edge 84 and cam surface 92.

In operation, each skirt sleeve of the platform is provided with grout injection ports prior to lowering the platform to the ocean floor. After platform placement, piles are driven through each of the skirt sleeves and a annular space is established between each pile and its skirt sleeve. Grouting equipment is brought adjacent to the platform on barge 21 and one end of the grouting hose 23 is lowered through the water into the vicinity of the skirt sleeve to be grouted. See FIG. 1. The upper end of the grouting hose is connected to a grout pump on barge 21 and the flexible lower end 23A is connecting to female movable portion 37 of the valve system. Grout is to be pumped down grouting hose 23 after female movable portion 37 mates to male fixed portion 17 of valve system 68 and into the annular space between the skirt sleeve and the pile through the grout inlet port in skirt sleeve 12 until the annular space has been filled with grout of a selected minimum density.

FIGS. 3 through 6 illustrate the connection and release of quick release platform grouting valve system 30.

FIG. 3 illustrates an ROV placing female movable part 37 in position to dock with male fixed part 17 of valve system 68. In the preferred embodiment, this is a vertical stab operation in which stabbing cone 60 aids in guiding the female movable portion into correct alignment, first with the upper edge of male fixed portion 17, then with a more precise alignment by engagement over engaging ring 94. See FIG. 4.

Further lowering of female movable portion 37 causes engaging sleeve 74 to surround the top of male fixed portion 17 and the shoulders of engaging ring 94 cam against camming surface 92 of cam latch 86, thereby driving the cam latch into spring housing 88 against the force of latch spring 90 to cause retaining edge 84 to retract from engagement with sliding sleeve 78. Also see FIG. 5. With the retaining edge retracted, sliding sleeve 78 is free to drop under the biasing of sleeve spring 80. The sliding sleeve then drops when locking balls 76 are in alignment with locking grooves 46 of male fixed portion 17, and the sliding lock sleeve urges locking balls 76 inward, into the inside diameter of the engaging sleeve and into the locking groove as they protrude through locking ball apertures 67.

The dropped position of sliding lock sleeve 78 secures the locking balls in this position and thereby secures the docked female movable part 37 to male fixed part 17 of valve system 68. An O-ring 100 secures the seal of the inside of the engaging sleeve 74 with the external circumference of male fixed portion 17 for the passage of grout through the grout flowing conduit of the secured valve system.

The drop of sliding lock sleeve 78 can be observed at positive engagement by the position of release handle 47 relative to stationary handle 48. The stationary handle is connected to female movable portion 37 at the external housing and the release handle is connected to the sliding lock sleeve through slots 102 of external housing 73 and the dropping of the sliding lock sleeve is observable as release handle 47 drops away from stationary handle 48.

After the movable and fixed portions of valve system 68 are secured together, wire 55 is cut and handle 54 rotated to open valve 53 which leads through the injection port into the annular space between piles 16 and skirt sleeve 12. See FIG. 2. Grout is then pumped through grouting hose 23 and valve system 68 to fill the annular space.

When grouting operations are complete at a particular grout inlet port, valve 53 is closed and normally-closed dump valve 52 is opened to flush grout from grouting hose 23. See FIG. 3. Dump valve 52 is closed and claws 32A of the ROV are brought into position to pull release handle 47 against stationary handle 48, thereby raising sliding lock sleeve 78 and allowing locking balls 76 to roll against the edge of locking groove 46 to withdraw therefrom. See FIG. 6. As female portion 37 is lifted from reception over male fixed portion 17 by ROV 30, engaging ring 90 moves across camming surface 92 of cam latch 86 and the cam latch advances from spring housing 88 such that releasing edge 84 comes beneath sliding lock sleeve 78 to return the female movable portion 37 to the pre-engagement position. Compare FIGS. 5 and 6 in this regard.

The female movable portion is then ready to stab onto the next male fixed portion 17 and the grouting operation repeats with ROV 30 carrying the female movable portion to each successor injection port.

Other modifications, changes and substitutions are intended in the foregoing disclosure and in some instances some features of invention will be employed without a corresponding use of other features. Accordingly, it is appropriate that the appended claims be construed broadly and in a manner consistent with the spirit and scope of the invention herein.

What is claimed is:

1. A quick release platform grouting valve system suitable for ROV operation for use in establishing a grout flowing conduit in deepwater environments between the lower end of a grouting hose and an annular space formed between a pile and a skirt sleeve, said valve system comprising:

a first valve portion connected to the first end of the grout flowing conduit, said first valve portion comprising:

a housing;

locking means carried within the housing;

a release handle operably connected to the locking means and protruding from the housing; and a stationary handle fixed to the housing and protruding therefrom adjacent the release handle; and a second valve portion connected to the second end of the grout flowing conduit, said second valve portion comprising:

a receiving means connected to the second end of the grout flowing conduit for cooperating with the locking means to secure the first end and the second end of the grout flowing conduit together.

2. A valve system in accordance with claim 1 wherein the first end of the grout flowing conduit in connected to the lower end of the grouting hose and the first valve portion is movable between a plurality of second valve portions fixed to the skirt sleeves.

3. A valve system in accordance with claim 2 wherein the movable first valve portion presents a female coupling member, and the second valve portion presents a male coupling member.

4. A valve system in accordance with claim 3 wherein the movable first valve portion is disposed for vertical docking and the lower end of the housing terminates in an upwardly converging stabbing cone.

5. A valve system in accordance with claim 4 wherein the housing comprises an external housing connected to the stationary handles and an internal housing presenting a downwardly depending female coupling member.

6. A valve system in accordance with claim 5 wherein the locking means comprises:

locking ball apertures about the lower circumference of the female coupling member;

a sliding lock sleeve disposed to axially slide between the external and the internal housings;

a sleeve spring disposed between the internal housing and the sliding lock sleeve biasing the sliding lock sleeve toward an engagement position;

a spring housing connected to the external housing;

a cam latch slidingly received within the spring housing and having one end protruding therefrom, said cam latch comprising:

a base;

a retaining edge on the protruding end of the base disposed to receive the sliding lock sleeve when the cam latch is extended;

a camming surface on the protruding end of the base; and a latch spring engaging surface on the end of the base opposite the protruding end;

a latch spring secured in the spring housing and engaging the cam latch to bias it into a protruding position;

a plurality of locking balls disposed at the locking ball apertures between the female coupling member and the sliding lock sleeve;

a groove on the male coupling member disposed to receive the locking balls protruding through the locking ball apertures when pressed therein by the sliding lock sleeve; and an engaging ring on the second valve portion disposed to engage the camming surface of the cam latch when received into the female first valve portion.

7. A valve system in accordance with claim 6 wherein the release handle is connected to the sliding lock sleeve and protrudes through the housing of the first valve portion through longitudinal slots in the external housing.

8. A valve system in accordance with claim 7 further comprising a tee at the connection of the first valve portion and the grouting base having a normally closed dump valve at its branch.

9. A quick release platform grouting valve system suitable for ROV operation for use in establishing a grout flowing conduit in deepwater environments between the lower end of a grouting hose and an annular space formed between a pile and a skirt sleeve, said valve system comprising:

a movable portion connected to the lower end of the grouting hose, said movable portion comprising:

a housing, comprising:

(i) an upper housing connected to the lower end of the grouting hose; and (ii) an external housing connected to the upper housing at one end and terminating in a downwardly opening stabbing cone at the other end;

a female coupling member carried within the external housing between the grouting hose and the stabbing cone;

a locking means carried within said housing comprising:

(i) a sliding lock sleeve slidingly received between the external housing and the female coupling member;

(ii) a sleeve spring disposed between the internal housing and the sliding lock sleeve and urging the sliding lock sleeve down over the female coupling member;

(iii) a spring housing connected to the external housing;

(iv) a cam latch slidingly received within the spring housing and having one end protruding through the external housing toward the internal housing, said cam latch comprising:

a base;

a retaining edge on the upper side of the protruding end of the base; and a camming surface on the lower side of the base at the protruding end;

(v) a latch spring within the spring housing and engaging the cam latch to urge it into a protruding position; and (vi) a plurality of locking balls disposed at the locking ball apertures between the female coupling member and the sliding lock sleeve;

a stationary handle extending outwardly substantially perpendicularly from the external housing to which it is connected;

a release handle connected to the sliding lock sleeve and extending outwardly through a slot in the external housing to project adjacent and substantially parallel to the stationary handle;

a tee at the connection of the movable portion to the grouting hose; and a normally closed dump valve at the branch of the tee; and a fixed portion rigidly connected to the skirt sleeve and in communication with the annular space between the pile and the skirt sleeve, said fixed portion comprising:

a grout inlet port;

an upwardly directed male coupling member receivable within the female coupling member in grout flowing communication at the upper end of the grout inlet port;

a circumferential groove on the exterior of the male coupling member disposed to receive locking balls protruding through the locking ball apertures when pressed therein by the sliding lock sleeve;

an engaging ring on the grout inlet port beneath the circumferential groove which is disposed to cam against the camming surface of the cam latch, causing the cam latch to withdraw from the sliding lock sleeve and thereby release the sliding lock sleeve when the female coupling member is stabbed over the male coupling member; and a selectively closable valve in the inlet port between the engaging ring and the skirt sleeve.

10. In a platform grouting valve system for use in establishing a grout flowing conduit between the lower end of a grouting hose and an annular space formed between a pile and a skirt sleeve, the improvement for quick release by an ROV comprising:

a first valve portion connected to one end of the grout flowing conduit, comprising a housing; and a locking means carried by the housing;

a second valve portion connected to the other end of the grout flowing conduit having a means for receiving the locking means;

an outwardly extending release handle operably connected to the locking means for releasing the connection between the first and the second valve portions; and a stationary handle outwardly extending from the housing parallel and substantially adjacent the release handle;

whereby the ROV conveniently grasps both the release handle and the stationary handle and manipulates relative motion therebetween causing the locking means to release the connection between the first and second valve portions.

11. A valve system in accordance with claim 10 wherein the one end of the grout flowing conduit is connected to the lower end of the grouting hose and the first valve portion is movable between a plurality of the second valve portions fixed to the skirt sleeves.

12. A valve system in accordance with claim 11 wherein the movable first valve portion presents a female coupling member and the second valve portion presents a cooperating male coupling member.

* * * * *